United States Patent [19]

Sollinger

[11] Patent Number: 5,005,515

[45] Date of Patent: Apr. 9, 1991

[54] SMOOTHING DEVICE OF A COATING APPLICATOR UNIT

[75] Inventor: Hans-Peter Sollinger, Heidenheim, Fed. Rep. of Germany

[73] Assignee: J. M. Voith GmbH, Fed. Rep. of Germany

[21] Appl. No.: 365,475

[22] Filed: Jun. 13, 1989

[30] Foreign Application Priority Data

Sep. 23, 1988 [DE] Fed. Rep. of Germany ..... 3832325

[51] Int. Cl.[5] ..... B05C 11/04

[52] U.S. Cl. ..... 118/100; 118/413

[58] Field of Search ..... 118/100, 261, 413; 427/356

[56] References Cited

U.S. PATENT DOCUMENTS

| | | | |
|---|---|---|---|
| 3,070,461 | 12/1962 | Beachler | 427/356 |
| 4,158,495 | 6/1979 | Seelenbinder et al. | 118/261 X |
| 4,250,211 | 2/1981 | Damrau et al. | 118/413 X |
| 4,534,309 | 8/1985 | Damrau et al. | 118/413 X |
| 4,706,603 | 11/1987 | Wohlfeil | 118/413 X |
| 4,738,877 | 4/1988 | Krautzberger | 118/261 X |

FOREIGN PATENT DOCUMENTS

| | | | |
|---|---|---|---|
| 921418 | 3/1963 | United Kingdom | 118/413 |

*Primary Examiner*—Richard L. Chiesa

*Attorney, Agent, or Firm*—Ostrolenk, Faber, Gerb & Soffen

[57] ABSTRACT

A smoothing device for an applicator unit for applying a coating on a moving web of fabric, or the like. A hollow supporting beam supports a doctor element via a holding device carried on the beam. A supporting body extends through the beam. An outer pipe surrounds the supporting body and is radially spaced therefrom. Hydraulic pressure elements between the outer pipe and the supporting body transmit forces to the supporting body. At circumferentially spaced locations around the outer pipe, the outer pipe engages the interior of the beam, defining liquid transmission channels located circumferentially between the connections to the support beam around the outer pipe. The channels permit liquid to be transmitted axially of the support beam for transferring heat along and eliminating localized heat stress on the beam. Various cross-sectional shapes of the outer pipe and of the beam are disclosed.

35 Claims, 2 Drawing Sheets

SMOOTHING DEVICE OF A COATING APPLICATOR UNIT

BACKGROUND OF THE INVENTION

The present invention relates to a smoothing device of an applicator unit for coating a moving web. The smoothing device includes a doctor, in the form of a doctor blade, which is supported on a beam and extends across the width of the web. The beam, and thus the doctor, are likely to bend or sag under their own weight or due to the pressure applied by the doctor against the web.

The invention compensates for the bending of the supporting beam which is stressed by its own weight and by the pressure and forces resulting from the operation. For a web coating or smoothing unit, the supporting beam carries a doctor element via a mount therefor. The doctor element is pressed by an adjusting device against a web being coated which, in general, is guided over a counter-roll opposed to the doctor element. To produce a coating which is as uniform as possible, it is important that the pressing of the doctor element against the web also takes place uniformly over the width of the web. Numerous beam deflection and sag compensation devices are known in the web treatment arts, including the coating arts. Some distribute their deflection resistance or compensation differently at various locations along the beam and/or around the beam. Some use one or more hydraulic chambers for effecting compensation.

SUMMARY OF THE INVENTION

It is an object of the present invention to further develop the beam support and deflection compensation arrangement such that complete compensation for the bending of the supporting beam is possible, even in the case of temperature differences along the beam length or around the beam.

For achieving this object, cooling channels extend through the beam in order to prevent thermal stresses in the supporting beam.

A smoothing device of an applicator unit for smoothing a coating on a moving web comprised of fabric, or the like, includes a hollow supporting beam, which supports a doctor element via a holding device carried on the beam. A central supporting body extends through the hollow beam. An outer pipe also inside the beam surrounds and is radially spaced out from the supporting body. Hydraulic pressure elements between the outer pipe and the supporting body transmit forces to the supporting body. The outer pipe, in turn, is fastened at circumferentially spaced locations around that pipe to the interior of the supporting beam. This defines fluid transmission channels circumferentially between the connections to the support beam around the outer pipe. The fluid channels permit fluid to be transmitted axially of the support beam along the channels for transferring heat along the channels and for eliminating localized heat stress on the beam.

The beam is preferably polygonal. In a preferred embodiment, the beam is generally square in cross section. But the beam may be otherwise shaped, for example, polygonal in a shape corresponding generally to the shape of the outer pipe within it, but radially spaced out from the outer pipe.

The outer pipe is generally cylindrically shaped. In a preferred embodiment, the outer pipe is circular in cross-section. But, it may be polygonal, e.g. octagonal. At least in part, the beam and the outer pipe may have correspondingly shaped profiles.

The outer pipe is connected to the beam generally at the centers of the sides of the interior of the beam. Preferably, the connections between the outer pipe and the beam are symmetrical around the outer pipe. There are in the range of four to eight of such connections uniformly distributed on the circumference of the outer pipe, equally spaced apart, with a maximum deviation of at most 10%.

The pressure elements between the inner support body and the outer pipe are arranged in rows or lines parallel to the longitudinal axis of the supporting beam and are acted upon hydraulically or pneumatically in the usual manner for such beams. Preferably, the pressure elements are shaped and placed to be symmetrical with respect to the connections between the outer pipe and the interior of the beam.

In one preferred embodiment, the supporting beam is comprised of a plurality of angle sections, each angled to define one apex of the polygonal beam, and the angle sections are fastened at adjacent side ends for defining a complete beam. The fastening locations for the angle sections are also the locations at which the outer pipe of the supporting means is secured inside the supporting beam.

More generally stated, inside the supporting beam is defined a deflection controllable supporting means for the beam, and appropriate means are provided inside the beam for controlling the deflection of the beam, for maintaining the holding device of the doctor element so that uniform pressure is applied to the web by the doctor element across the web.

It is to be endeavored in this connection to have a preferably symmetrical arrangement or development of the supporting beam with respect to the arrangement of the pressure elements which exert stress on the outer pipe. However, one can also deviate from this. An even number of channels can, in particular, be provided for a liquid medium which serves as a heat carrier, so that for both directions of flow along the axis of the supporting beam, equally large cross sections are available for the heat transfer.

Other objects and features of the invention are explained below with reference to the drawings.

DESCRIPTION OF THE PREFERRED EMBODIMENTS

Figure 1:
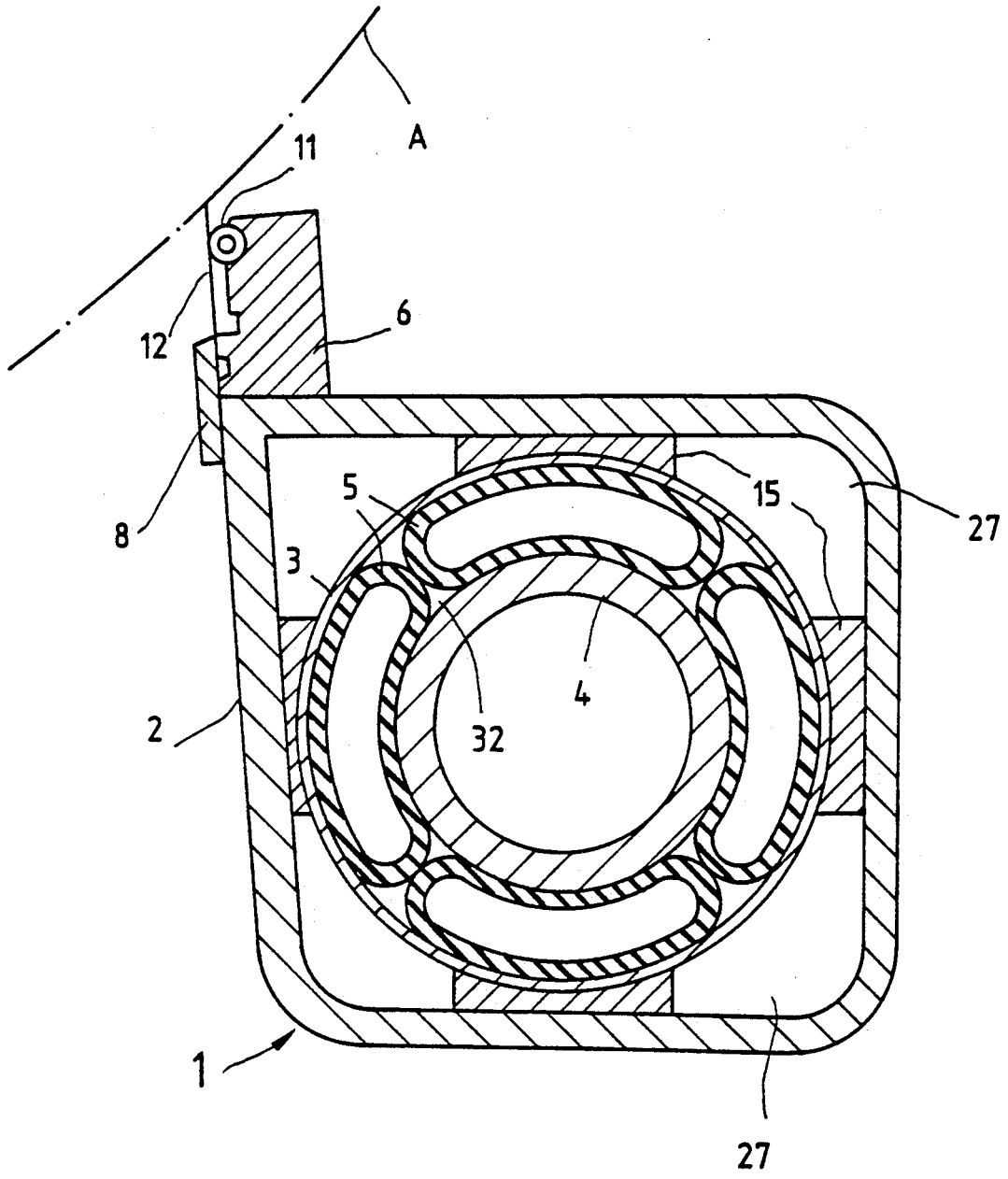
FIGS. 1, 2 and 3 show cross sections of three embodiments of the supporting beam of the invention.

FIG. 1 shows a first embodiment of a smoothing unit 1. A doctor element holding device 6 is located on the periphery of a supporting beam 2. The device 6 carries a doctor element 12, which is developed in this case as a coating blade. The element 12 is held to the device 6 by means of a clamping ledge 8. The blade or element 12 is pressed by a small pressure hose 11 against a web of fabric, or the like or against a counter-roll A on which the fabric is supported, as shown in dot-dash line.

Inside the supporting beam 2, there is a central supporting body 4 which is developed as a hollow cylinder or pipe. The supporting beam 2 is supported on the supporting body 4 by an outer pipe 3 which is spaced radially outward of the supporting body 4 and serves as a holding element and by four pressure hoses 5 arrayed between the pipe 3 and the body 4 which can be pressurized hydraulically or pneumatically.

Between the outer pipe 3 and the supporting beam 2, and associated respectively with each of the pressure hoses 5, there is one respective supporting wall 15 which transfers the pressure from the respective pressure hose to the pipe 3 and thus to the supporting beam 2. The supporting walls 15 have the same axial length as the supporting beam 2, or the outer pipe 3 or the inner pipe 4. The walls 15 can merely rest against the insides of the walls of the supporting beam 2 which enables relative sliding movement between the walls 15 and the supporting beam 2. The inner surfaces of the walls of the supporting beam 2 and the cooperating slide surfaces on the supporting walls 15 can be made smooth along the surfaces of contact between the beam and the supporting walls, allowing deflection of the pipe 3.

Although not shown here, the entire smoothing unit 1 is generally mounted swingable, that is, pivotable at different pivot angles around its pivot mounts at the ends of the unit to enable different angular positions of the coating blade 12 with respect to the tangent to the counter-roll A to be set. As a result, the bending of the supporting beam 2 can take place in different radial planes. The individual pressure hoses 5 are accordingly acted upon by different selected pressures in circumferential sequence, in each case so that the resulting pressure eliminates undesired bending or deflection of the supporting beam, or reduces or changes that bending line to produce a uniform pressing force of the coating blade 12 against the counter-roll A or the web of fabric. The bending of the counter-roll A must also be taken into account. It is therefore possible to act with a uniform pressure on the coating blade 12 via the pressure hose 11 and to effect the compensation at least in part via the pressure hoses 5.

Projections 32 are advisedly provided at spaced locations around the periphery of the supporting body 4 in order to fix the circumferential positions of the pressure hoses 5.

Because the exterior of the outer pipe 3 and the interior of the hollow supporting beam 2 have different profiles, e.g. the beam 2 is nearly rectangular or square, while the pipe 3 is generally circular, hollow spaces 27 are produced between the supporting beam 2 and the supporting walls 15. These spaces serve as channels for holding and transmitting cooling liquid. In general, a liquid medium can circulate in the channels 27 for transferring heat along the beam 2 in order to prevent deformations or warping of the supporting beam 2 due to the localized influence of temperature and heat stresses. In this connection, equal streams of cooling liquid are preferably provided in both axial directions of flow.

Figure 2:
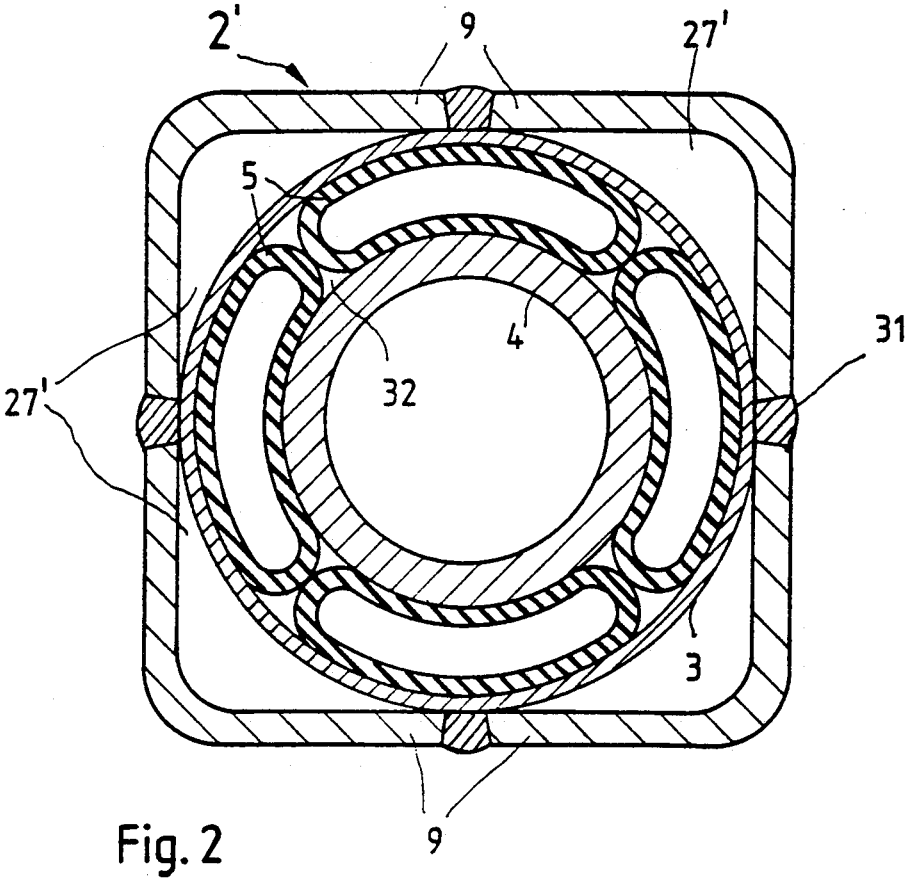

In accordance with the second embodiment of FIG. 2, hollow spaces for the formation of channels 27' are created where the beam 2 is formed of four elongate angle sections 9, each bent at its middle at a right angle, and the side edges of adjacent ones of the sections are connected to define a completed polygon. The edges of the angle sections are welded in place on the outer pipe 3. The angle sections are in a symmetrical arrangement defining a polygonal, e.g., a generally square, cross-section hollow supporting beam 2 around the outer pipe 3. The angled bend in each angle section defines a corner of the polygonal shape of the beam. This results in particularly clear conditions, favorable for temperature equalization. Supporting walls like walls 15 are not needed since the outer pipe extends to the beam interior. This occurs particularly because the beam is square, but also would be true for any other polygonal shape thereof. The angle sections are respectively equal in size and shape, and are arranged symmetrically, defining a mirror image arrangement in cross section perpendicular to the axis of the beam.

Figure 3:
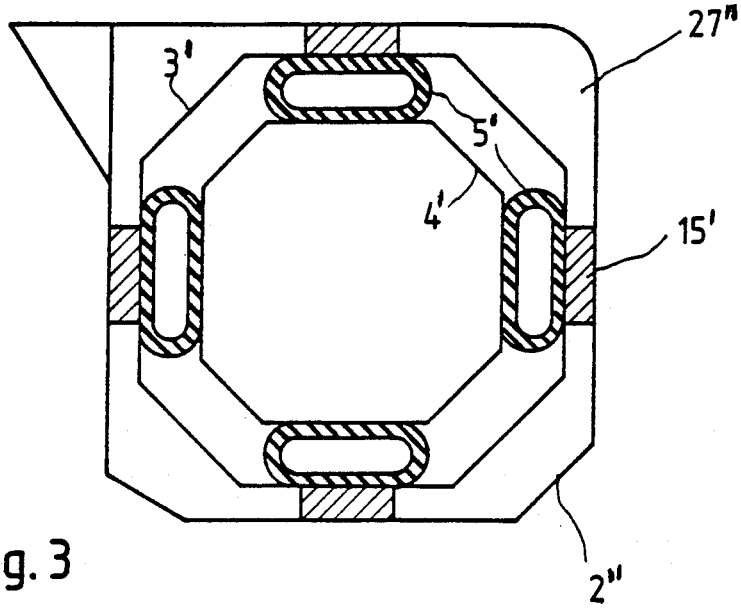

FIG. 3 illustrates a system wherein the outer pipe 3' also has a polygonal cross-section, with an octagonal shape being shown. It is preferable to use at least a six sided, six angled polygon, of which the embodiment of FIG. 3, with its eight sides and angles, is an example. The inner support 4' may also be in the shape of a matching polygon. The pneumatically chargeable compression hoses 5' will accordingly be positioned between the inner support 4' and the outer pipe 3'.

Beam 2'' is supported essentially along every side, and preferably in the vicinity of compression hoses 5', on supporting strips 15', which are secured stationary to the outer pipe 3' and to the beam. This arrangement creates axial channels 27'' along the beam for transferring a preferably liquid coolant, similar to those channels in the other embodiments. The cross-section, particularly of the interior, of beam 2'' is equivalently polygonal. The bottom of the beam in FIG. 3 shows how the alternation between a short polygon side and a long polygon side creates channels for the coolant when the short side occurs between compression hoses 5'. Coolant channels will also occur in this region when supporting strips 15' are relatively flat, as illustrated. This produces a design that saves space over the cross-section.

The embodiments illustrated in FIGS. 1 and 2, wherein the pipe 3 is circular in cross-section, are simpler in principle to manufacture, because a pipe of that shape is commercially obtainable. Basically, the cross-section of the polygonal outer pipe 3' illustrated in FIG. 3, which is a symmetrical octagon, very closely approximates a circle, and a circular pipe can of course very easily be employed in the embodiment of FIG. 3 for simplicity, if desired.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A smoothing device for supporting a doctor element in engagement with a moving surface, the device comprising:

a hollow supporting beam extending across the width of the moving surface; a doctor element supported on the beam and projecting from the beam toward the moving surface;

a central supporting body extending through the hollow beam; an outer pipe also extending through the beam, disposed around the supporting body and radially spaced therefrom; a plurality of pressure elements disposed between the supporting body and the outer pipe and extending along the length of the beam, for transmitting force from the outer pipe to the supporting body within;

a plurality of connections from the exterior of the outer pipe to the supporting beam for transmitting forces applied by the beam and forces applied by the doctor element to the beam, through the connections to the outer pipe, and the connections between the outer pipe and the beam being placed for defining elongate channels extending through the hollow beam and outside the outer pipe for transmitting a fluid medium along the channels for heat transmission.

2. The smoothing device of claim 1, wherien the pressure elements are arranged extending parallel to the axis of the beam.

3. The smoothing device of claim 1, wherein the outer pipe has the shape of a circular cylinder and the interior of the beam has a polygonal cross section for defining the channels between the beam and the outer pipe.

4. The smoothing device of claim 3, wherein the connections between the beam and the outer pipe are at circumferentially and approximately equally spaced apart locations.

5. The smoothing device of claim 3, wherein the polygonal cross section of the beam is a generally square shape.

6. The smoothing device of claim 3, wherein the beam is comprised of a plurality of axially extending sections each angled to define a respective corner of a polygon, and the sections having side edges placed such that adjacent edges of adjacent sections are connected to the outer pipe over the axial length of the outer pipe and of the beam for defining the connections between the beam and the outer pipe.

7. The smoothing device of claim 6, wherein the edges of the sections are connected to the outer pipe by being welded thereto.

8. The smoothing device of claim 6, wherein the angle sections are respectively equally large as mirror images in cross section perpendicular to the longitudinal axis of the beam.

9. The smoothing device of claim 6, wherein adjacent edges of adjacent sections are firmly connected to each other.

10. The smoothing device of claim 3, wherein the pressure elements are shaped, sized and positioned so that their cross sections are generally central along the sides of the polygonal supporting beam.

11. The smoothing device of claim 10, wherein there is one respective row of pressure elements at each opposite side of the supporting beam.

12. The smoothing device of claim 10, wherein the supporting beam is comprised of a plurality of axially extending sections each angled to define a respective corner of a polygon, and the sections having edges such that the edges of neighboring sections are connected to the outer pipe over the axial length of the outer pipe and of the beam for defining the connections between the beam and the outer pipe, wherein the cross sections of the pressure elements are so shaped and the pressure elements are so placed that the pressure elements substantially bridge equal distances toward both sides of adjacent angle sections.

13. The smoothing device of claim 12, wherein adjacent edges of adjacent sections are firmly connected to each other.

14. The smoothing device of claim 1, comprising four of the connections between the outer pipe and the beam.

15. The smoothing device of claim 1, wherein the connections between the beam and the outer pipe are symmetrically spaced around the outer pipe.

16. The smoothing device of claim 1, wherein the connections between the beam and the outer pipe are symmetric around the outer pipe with respect to the pressure elements arranged around the outer pipe.

17. The smoothing device of claim 1, wherein the beam is comprised of a plurality of axially extending sections each angled to define a respective corner of a polygon, and the sections having side edges placed such that adjacent edges of adjacent sections are connected to the outer pipe over the axial length of the outer pipe and of the beam for defining the connections between the beam and the outer pipe.

18. The smoothing device of claim 17, wherein adjacent edges of adjacent sections are firmly connected to each other.

19. The smoothing device of claim 1, wherein the connections between the beam and the outer pipe comprise supporting wall elements therebetween.

20. The smoothing device of claim 19, wherein the supporting wall elements are in surface engagement with the interior of the beam and are not affixed thereto enabling relative sliding of the supporting wall elements with respect to the beam.

21. The smoothing device of claim 1, wherein the outer pipe has a polygonal cross-sectional shape.

22. The smoothing device of claim 21, wherein the interior of the beam has a polygonal cross-section but a larger cross-section than the outer pipe for defining the channels between the beam and the outer pipe.

23. The smoothing device of claim 22, wherein the outer pipe is a polygon with at least six angles.

24. The smoothing device of claim 22, wherein the beam is comprised of a plurality of axially extending sections each angled to define a respective corner of a polygon, and the sections having side edges placed such that adjacent edges of adjacent sections are firmly connected to each other.

25. The smoothing device of claim 22, wherein the polygonal shape of the outer pipe includes a number of sides; the interior of the beam also has a number of sides, and at least some of the sides of the interior of the beam are parallel to and spaced apart from the sides of the outer pipe for defining one of the channels between them.

26. The smoothing device of claim 25, wherein the beam is comprised of a plurality of axially extending sections each angled to define a respective corner of a polygon, and the sections having side edges placed such that adjacent edges of adjacent sections are firmly connected to each other.

27. The smoothing device of claim 1, wherein the supporting beam is comprised of a plurality of axially extending sections each angled to define a respective corner of a polygon, and the sections having edges such that the edges of neighboring sections are connected to the outer pipe over the axial length of the outer pipe and of the beam for defining the connections between the beam and the outer pipe, wherein the cross sections of the pressure elements are so shaped and the pressure elements are so placed that the pressure elements substantially bridge equal distances toward both sides of adjacent angled axially extending sections.

28. The smoothing device of claim 27, wherein adjacent edges of adjacent sections are firmly connected to each other.

29. A smoothing device for supporting a doctor element in engagement with a moving surface, the device comprising;

a hollow supporting beam extending across the width of the moving surface; a doctor element supported on the beam and projecting from the beam toward the moving surface;

a central supporting body extending through the hollow beam; an outer pipe also extending through the beam, disposed around the supporting body and radially spaced therefrom; a plurality of pressure elements disposed between the supporting body and the outer pipe and extending along the length of the beam, for transmitting force from the outer pipe to the supporting body within;

a plurality of connections from the exterior of the outer pipe to the supporting beam for transmitting forces applied by the beam and forces applied by the doctor element to the beam, through the connections to the outer pipe, and the connections between the outer pipe and the beam being placed for defining elongate channels extending through the hollow beam and outside the outer pipe for transmitting a fluid medium along the channels for heat transmission;

wherein the pressure elements are arranged extending parallel to the axis of the beam; and wherein the pressure elements are hydraulic pressure elements.

30. A smoothing device for supporting a doctor element in engagement with a moving surface, comprising:

a hollow supporting beam extending across the direction of extension of the moving surface, and a doctor element supported on the beam toward the moving surface;

supporting means inside the beam and extending along the length of the beam, the supporting means having an external profile and the beam having an internal profile which are differently shaped in their cross sections for producing circumferentially spaced apart channels around the periphery of the supporting means within the beam, the channels being positioned for transmitting fluid therealong for heat transmission along the beam, for avoiding localized heat stress;

means connecting the exterior of the supporting means with the interior of the beam at circumferentially spaced intervals around the beam and extending along the length of the beam for defining the channels between the connecting means;

beam deflection control means at the supporting means and the beam, the control means being adjustable for controlling the deflection of the beam and of the doctor element supported thereby.

31. The smoothing device of claim 30, wherein the supporting means is generally coaxial with the beam.

32. The smoothing device of claim 31, wherein the supporting means is an elongated hollow member within the beam and connected to the interior of the beam at circumferentially spaced intervals around the periphery of the elongated hollow member.

33. A smoothing device for supporting a doctor element in engagement with a moving surface, comprising:

a hollow supporting beam extending across the direction of extension of the moving surface, and a doctor element supported on the beam toward the moving surface;

supporting means inside the beam and extending along the length of the beam, the supporting means having an external profile and the beam having an internal profile which are differently shaped in their cross sections for producing circumferentially spaced apart channels around the periphery of the supporting means within the beam, the channels being positioned for transmitting fluid therealong for least transmission along the beam, for avoiding localized heat stress;

means connecting the exterior of the supporting means with the interior of the beam at circumferentially spaced intervals around the beam and extending along the length of the beam for defining the channels between the connecting means;

beam deflection control means at the supporting means and the beam, the control means being adjustable for controlling the selection of the beam and of the doctor element held thereby;

wherein the beam deflection control means comprises a plurality of pressure elements extending along the length of the beam within the supporting means.

34. The smoothing device of claim 33, wherein the pressure elements are arranged parallel to the axis of the beam.

35. The smoothing device of claim 34, wherein the pressure elements are hydraulic pressure elements.

* * * * *